US005259786A

United States Patent [19]

Huang

[11] Patent Number: 5,259,786

[45] Date of Patent: Nov. 9, 1993

[54] LAMP UNIT BATTERY SEAT

[75] Inventor: Chin J. Huang, Taipei, Taiwan

[73] Assignee: Londa Photo Products Co., Ltd., Taiwan, China

[21] Appl. No.: 905,381

[22] Filed: Jun. 29, 1992

[51] Int. Cl.[5] ..... H01R 3/00

[52] U.S. Cl. ..... 439/500; 439/217; 429/98; 429/100

[58] Field of Search ..... 429/97-100, 429/7, 9; 439/500, 620-622, 217-221, 928; 320/2; 361/393, 394, 399, 194

[56] References Cited

U.S. PATENT DOCUMENTS

| | | | |
|---|---|---|---|
| 3,735,116 | 5/1973 | Morrison | 439/220 |
| 4,191,917 | 3/1980 | Brown et al. | 439/221 |
| 4,847,170 | 7/1989 | Martin | 429/99 |
| 5,058,045 | 10/1991 | Ma | 439/928 |
| 5,059,885 | 10/1991 | Weiss et al. | 429/100 |

FOREIGN PATENT DOCUMENTS

| | | | |
|---|---|---|---|
| 0179990 | 7/1990 | Japan | 429/99 |

*Primary Examiner*—David L. Pirlot

*Attorney, Agent, or Firm*—Jacobson, Price, Holman & Stern

[57] ABSTRACT

A lamp unit for use in photography or video taping having a battery seat which can accommodate batteries of differing configurations. The lamp unit comprises a lamp body and a back plate which defines the battery seat. A plurality of electrical terminals are positioned about the back plate such that when a battery is attached thereto the battery terminals, irrespective of their location on the battery, will be in electrical contact with the terminals on the back plate.

7 Claims, 4 Drawing Sheets

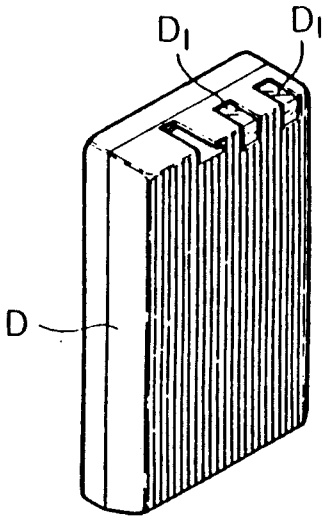
FIG. ID
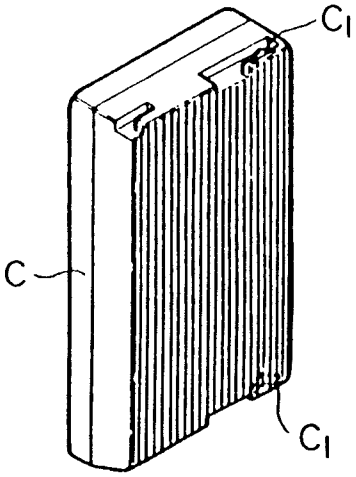
FIG. IC
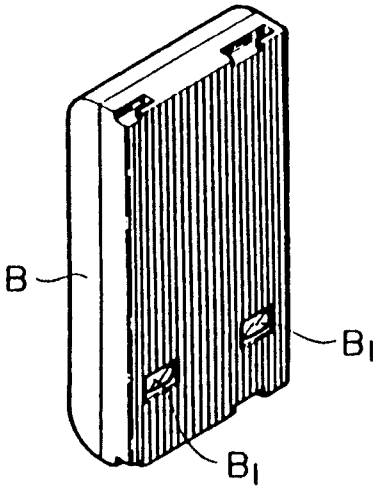
FIG. IB
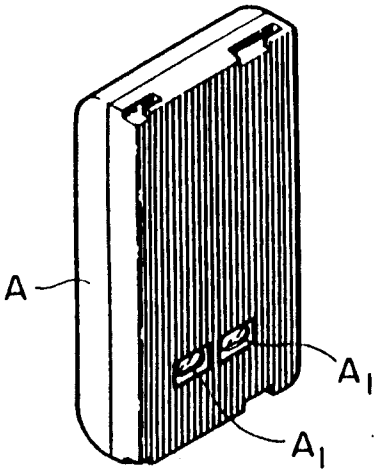
FIG. IA

LAMP UNIT BATTERY SEAT

FIELD OF THE INVENTION

This invention relates to a photographic camera lamp unit battery seat. More particularly the invention relates to a photographic or video tape camera lamp unit, battery seat which is capable, through its configuration, of accommodating a variety of batteries of differing brands and configurations.

BACKGROUND OF THE INVENTION

The portable video camera is increasing in popularity due to its light weight and efficient and convenient operation which insures that the images and sounds of all types of activities, such as weddings, ceremonies, travel, sightseeing, family events, etc., can be accurately recorded. With the advent of the video camera's increasing popularity the price of such cameras has dropped, thereby insuring continued popularity. When these cameras are to be used in situations where the ambient light is not high, such as for example indoors or at night, a lamp unit is required in order to supplement the existing light. There are currently two types of electric power supplies for such lamp units: in one case, the power stems from the battery pack of the camera itself; in other case, the power stems from an independent battery pack which is not shared with the camera. In the case where the battery pack is shared, there are inherent disadvantages since a battery pack can only store a limited amount of electricity and therefore if both the camera and the lamp unit rely on the same battery pack for energy, such a battery pack becomes drained of energy much faster. Therefore, manufacturers have tended to favor independent battery packs which are used because lamp units which rely on such battery packs are provided with enhanced brightness and uniformity of light. As a result, there are now large numbers of diverse brands on the market, such as for example: SONY; PANASONIC; CANON; KYOCERA; etc. Since each manufacturer conducts its research and development in independent fashion and without coordination with other manufacturers, the resulting lamp units differ not only in outward appearance but also in the position of the electricity-conducting end of the battery pack as well. Referring now to FIG. 1, FIG. 1—1 depicts a SONY brand battery pack A provided with electricity-conducting terminals Al; FIG. 1-2 depicts a PANASONIC brand battery pack B provided with electricity-conducting terminals B1, which electricity-conducting terminals B1 differ in position with respect to the SONY electricity-conducting terminals A1; FIG. 1-3 depicts a KYOCERA brand battery pack C provided with electricity-conducting terminals C1 which likewise differ electricity-conducting terminals C1 and which also differ in position when compared to those of the other manufacturers; and FIG. 1-4 depicts a CANON bran battery pack D provided with electricity-conducting terminals D1, which also differ in position when compared to those of the other manufacturers. The individual battery packs are therefore designed such that they correspond only to the lamp units of the same brand. As a result of the foregoing, limitations currently exist in the use of lamp units. For example, in the case, of professional photographers, who use several brands of cameras, they must coordinate various battery packs corresponding to various brands of lamp units. Additionally, when the energy available in an individual battery pack is exhausted only a battery pack of identical configuration can be substituted.

A need therefore exists for a universal lamp unit which can accommodate battery packs independent of their brand and electricity-conducting terminal configuration.

SUMMARY OF THE INVENTION

It is an object of this invention to provide a lamp unit battery seat which can accommodate battery packs independent of their brand and electricity-conducting terminal configuration. More particularly, it is an object of the present invention to provide a lamp unit having a battery seat with electricity-conducting terminals disposed such that the seat can accommodate battery packs independent of their brand or configuration.

BRIEF DESCRIPTION OF THE DRAWINGS

FIGS. 1A-1D are a front perspective view of battery packs corresponding to: 1A SONY; 1B PANASONIC; 1C KYOCERA; and 1D CANON;

DETAILED DESCRIPTION OF THE INVENTION

The present invention relates to a photographic camera lamp unit having a back plate which defines a battery seat.

With reference to the Figures, in which like numerals represent like parts, FIG. 1 illustrates the prior art and FIGS. 2-5 illustrate preferred embodiments of the present invention.

Figure 2:
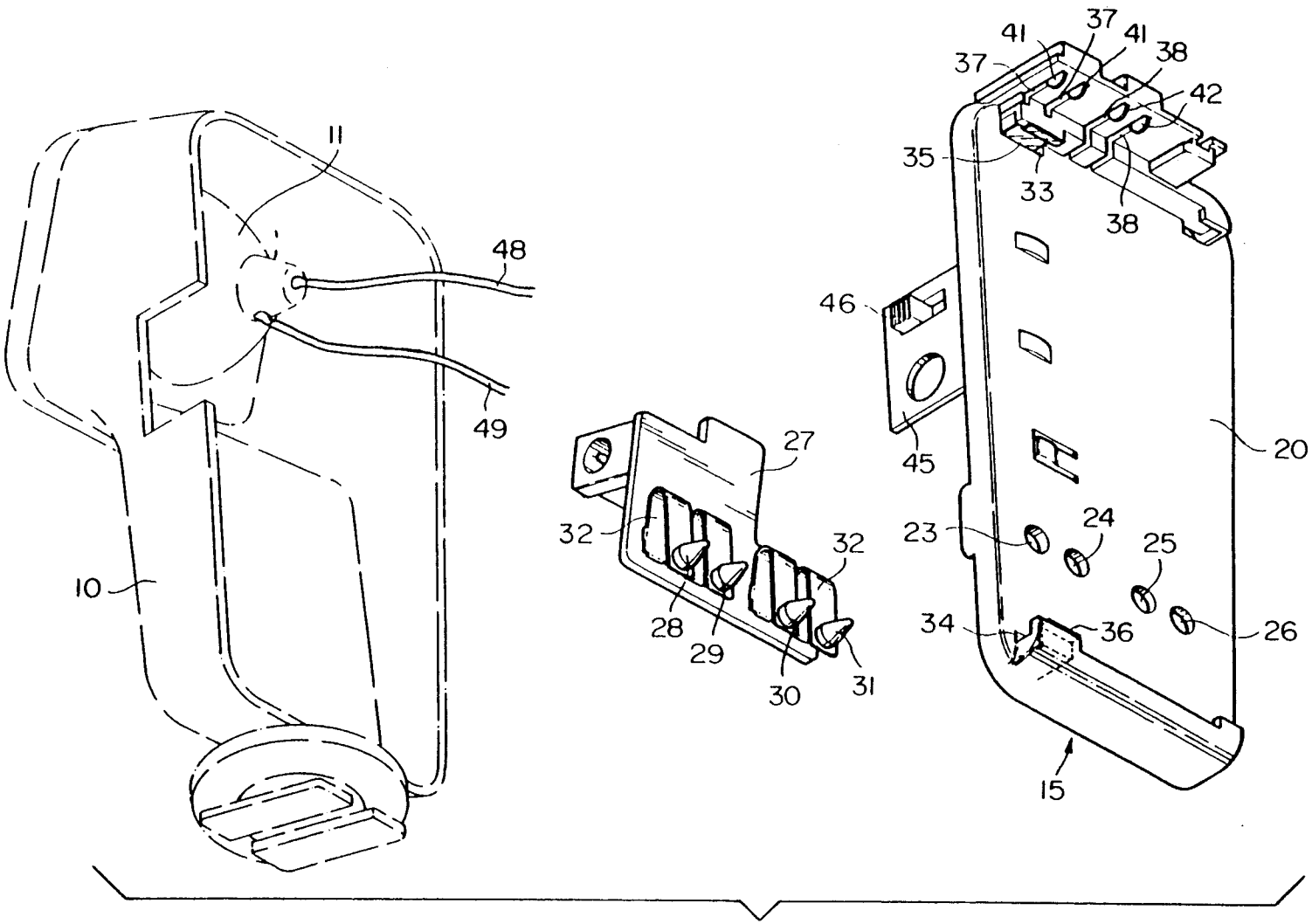
FIG. 2 is an exploded rear perspective view of the back plate of the lamp unit of the present invention.
Figure 4:
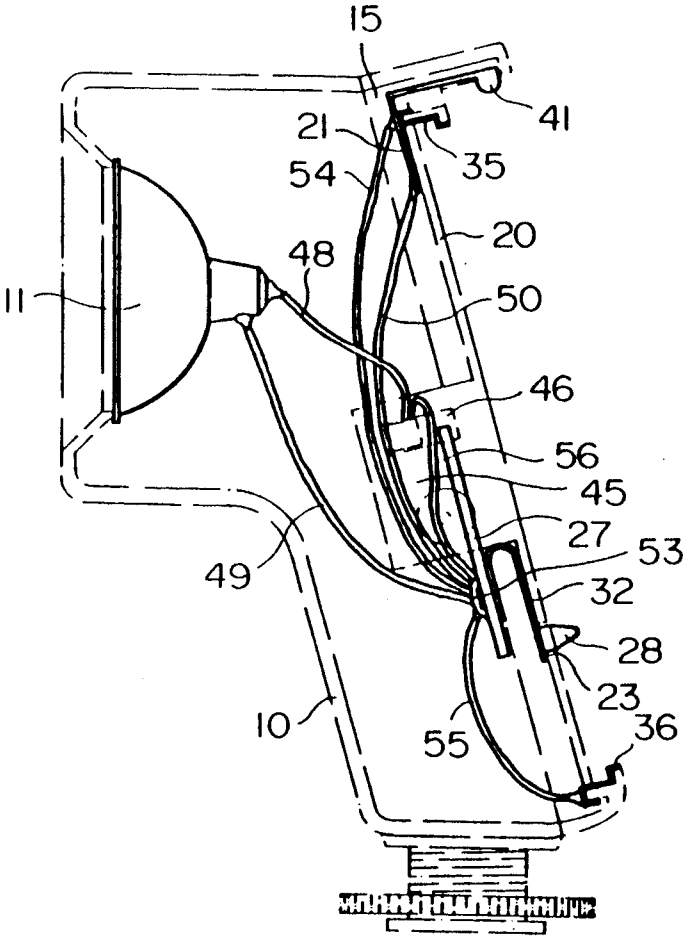
FIG. 4 is a side elevational view showing the wiring between the back plate and a lamp housing of the lamp unit being shown in phantom line.
Figure 3:
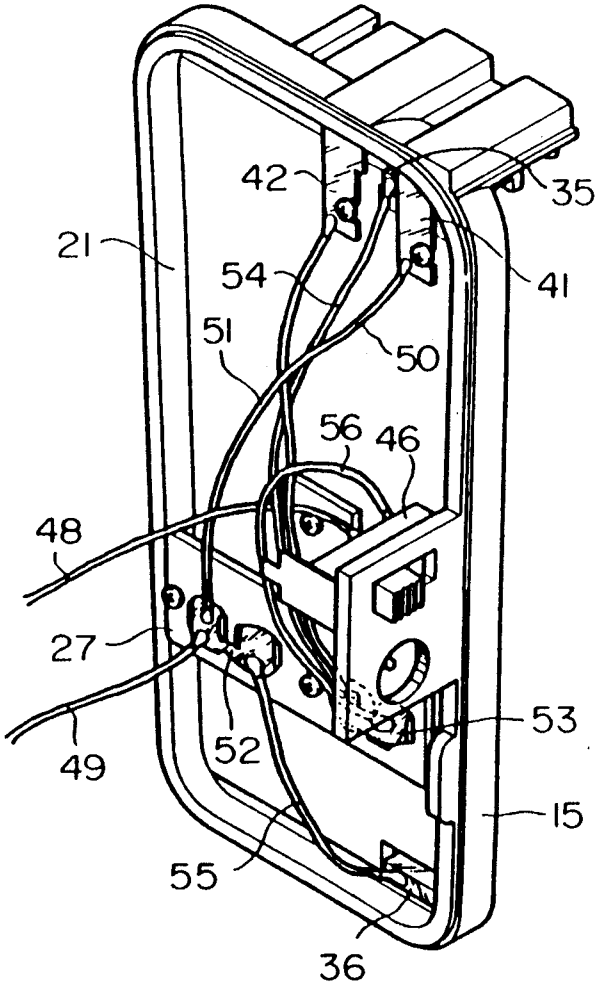
FIG. 3 is a front perspective view of the back plate of the lamp unit of the present invention.

As shown in FIGS. 2-4, the lamp unit of the present invention comprises a lamp housing 10 and a back plate 15. An exterior surface 20 of the back plate 15 is configured to accommodate the battery packs and contains a first lateral opening 23, a first medial opening 24, a second medial opening 25, and a second lateral opening 26. On an interior surface 21 of the back plate 15 and aligned with the openings 23, 24, 25 and 26 is a circuit board 27.

The circuit board 27 is provided with a first lateral contact terminal 28 and a second lateral contact terminal 31, each of which respectively fits into and through the lateral openings 23 and 26. The circuit board 27 is likewise provided with a first medial contact terminal 29 and a second medial contact terminal 30, each of which fits into and through the medial openings 24 and 25, respectively. Each of the contact terminals 28, 29, 30 and 31 is attached to the circuit board 27 by way of an electrically conductive elastic member 32. In addition, the first lateral contact terminal 28 is electrically connected to the first medial contact terminal 29, while the second lateral contact terminal 31 is electrically connected to the second medial contact terminal 30 (as shown in FIG. 3). It should be emphasized, however, that the first contact terminals 28 and 29 are not electrically connected to the second contact terminals 30 and 31.

A pair of lips 33 and 34 are disposed longitudinally across from one another on the exterior surface 20 of the back plate 15. In addition, there is an upper terminal 35 and a lower terminal 36 on the lip 33 and the lip 34, respectively.

The top of the exterior surface 20 is also provided with lateral grooves 37 and medial grooves 38, which are, in turn, provided with a lateral terminal 41 and a medial terminal 42, respectively. The exterior surface 20 of the back plate 15 is further provided with a side plate 45 which extends perpendicularly from the interior surface 21. A switch 46 is disposed on the side plate 45.

Referring now to FIG. 3, the interior surface 21 of the back plate 15 is illustrated. The lateral terminal 41, which extends between the interior and exterior surfaces 21 and 20 of the back plate 15, is connected to a first lead wire 50 which in turn is connected to a first electrical connector 52. The first electrical connector 52 also connects the second lateral contact terminal 31 to the second medial contact terminal 30. In addition, a second lead wire 55 connects the first electrical connector 52 electrically to the lower terminal 36 which extends between the interior and exterior surfaces 21 and 20 of the back plate 15.

The medial terminal 42, which also extends between the interior and exterior surfaces 21 and 20, is electrically connected to a second electrical connector 53 by way of a third lead wire 51. In addition, the second electrical connector 53 connects the first lateral contact terminal 28 electrically to the first medial contact terminal 29. A fourth lead wire 54 electrically connects the second electrical connector 53 to the upper terminal 35, while a fifth lead wire 56 electrically connects the second electrical connector 53 to the switch 46. The switch 46 is connected to a first lamp wire 48 which, in turn, is connected to a lamp bulb 11. There is also a second lamp wire 49 which additionally connects the lamp bulb 11 to the first electrical connector 52. An electrical circuit can thereby be completed through the lamp bulb 11. In order to fully appreciate the lead wire connections, reference is made to FIG. 4 which depicts a side view of the lamp of the present invention and wherein the wiring connections are illustrated.

The above described photographic camera lamp unit is compatible with different brands of battery packs as follows:

(1) SONY battery pack: when the battery pack A is inserted onto the exterior surface 20 of the back plate 15 the electricity-conducting terminals A1, which are situated in the lower, middle region of the battery pack, as shown in FIG. 1—1, are aligned and make contact with the first medial contact terminal 29 and the second medial contact terminal 30. The elastic members 32 insure proper contact between the terminals.

(2) PANASONIC battery pack: when the battery pack B is inserted onto the exterior surface 20 of the back plate 15 the electricity-conducting terminals B1 which are situated in the lower, outer region of the battery pack, as shown in FIG. 1-2, are aligned and make contact with the first lateral contact terminal 28 and the second lateral contact terminal 31. The elastic members 32 insure proper contact between the terminals.

(3) KYOCERA battery pack: when the battery pack C is inserted onto the exterior surface 20 of the back plate 15 the electricity-conducting terminals C1, which are situated at both the upper and lower edge regions of the battery pack, as shown in FIG. 1-3, are aligned and make contact with the upper terminal 35 and the lower terminal 36, respectively.

(4) CANON battery pack: when the battery pack D is inserted and engages the exterior surface 20 of the back plate 15 the electricity-conducting terminals D1 which are situated at the upper edge region of the battery pack, as shown in FIG. 1-4, are aligned and make contact with the lateral terminal 41 and the medial terminal 42.

Hence, irrespective of which particular battery pack is used, whenever a battery pack is positioned so as to engage the external surface 20, a pair of terminals from the group consisting of terminals 28, 29, 30, 31, 35, 36, 41, and 42, make electrical contact with the battery pack. The particular pair which makes contact, of course, depends on the type of battery pack used. Nevertheless, when the switch 46 is closed while a battery pack is in place, an electrical circuit is completed and electrical power is able to flow into the lamp unit of the present invention.

In the case of a SONY battery pack, electrical current flows from the electricity-conducting terminals A1, through the first medial contact terminal 29 to its corresponding elastic member 32 and then to second electrical connector 53. The current then continues through the fifth lead wire 56, to the switch 46 and then through the switch 46, to the first lamp wire 48. The electrical current next passes through the lamp bulb 11 and then through the second lamp wire 49 to the first electrical connector 52. The current then continues through the first electrical connector 52, to the second medial contact terminal 30 via its corresponding elastic member 32. The second medial contact terminal 30 then provides a return path to the battery pack via the electricity-conducting terminals A1.

In the case of a PANASONIC battery pack, electrical current flows from the electricity-conducting terminals B1 to the first lateral contact terminal 28, then through its corresponding elastic member 32, to the second electrical connector 53. From the second electrical connector 53, the electrical current flows through the fifth lead wire 56, to the switch 46 and then through the switch 46 to the first lamp wire 48. Next, the electrical current passes through the lamp bulb 11 and through the second lamp wire 49 to the first electrical connector 52. From the first electrical connector 52, the current then returns to the electricity-conducting terminals B1 via the second lateral contact terminal 31 and its corresponding elastic member 32.

In the case of a KYOCERA battery pack, the electrical current flows from one of the electricity-conducting terminals C1 to the upper terminal 35, then through the fourth lead wire 54, to the second electrical connector 53. The flow of electrical current then continues through the fifth lead wire 56, to the switch 46 and through the switch 46 to the first lamp wire 48. Current then passes, from the first lamp wire 48, through the lamp bulb 11, to the second lamp wire 49. From the second lamp wire 49, the current continues to flow through the first electrical connector 52 and then the second lead wire 55, to the lower terminal 36. The lower terminal 36 then provides a current path back to the electricity-conducting terminals C1.

In the case of a CANON battery pack, electrical current flows from the electricity-conducting terminals D1 to the medial terminal 42, then through the medial terminal 42 and third lead wire 51, to the second electrical connector 53. The flow of electrical current next continues through the fifth lead wire 56, to the switch 46 and then through the switch 46, to the first lamp wire 48. This current then passes through the lamp bulb 11 and through the second lamp wire 49, to the first electrical connector 52. From the first electrical connector 52 the flow of current then continues through the third lead wire 50, to the lateral terminal 41 and back to the electricity-conducting terminal D1.

Figure 5C:
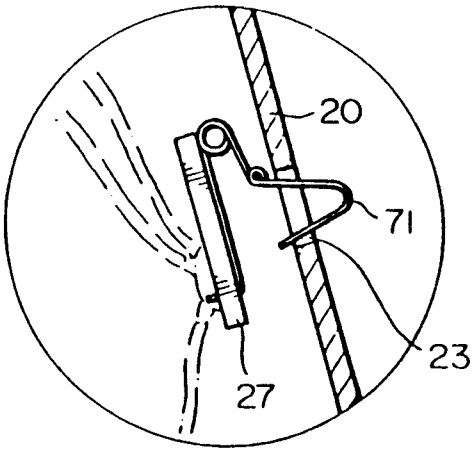
FIGS. 5(A-C) are enlarged views of the electrical connections of the back plate of the lamp unit of the present invention.
Figure 5B:
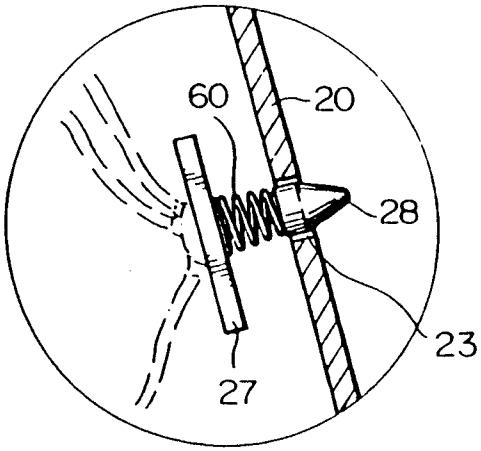
Figure 5A:
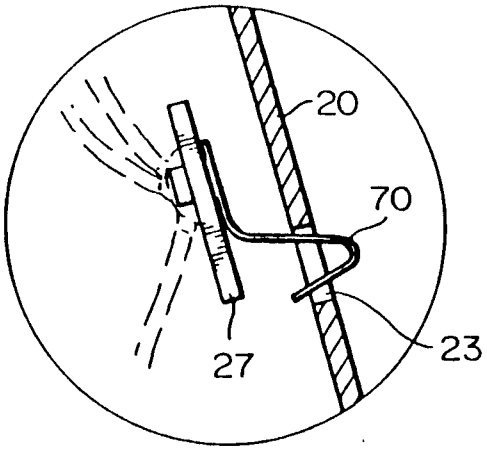

With reference to FIGS. 5(1-3), three alternative embodiments of a contact terminal assembly will now be described.

In FIG. 5-1, the circuit board 27 is provided with a bent, elastic electrode 70 which is affixed thereto and which protrudes, for example, through the first lateral opening 23 in the exterior surface 20 of the back plate 15.

In FIG. 5-2, the circuit board 27 is provided with, for example, a first lateral contact terminal 28' which is adjacent to and protruding through the first lateral opening 23 in the exterior surface 20 of the back plate 15. The first lateral contact terminal 28' is affixed to one end of an electrically conductive spring 60. The other end of the spring 60 is affixed to the circuit board 27.

In FIG. 5-3, the circuit board 27 is provided with an elastic electrode 71 which is affixed thereto and which is adjacent to and protrudes through the first lateral opening 23 in the exterior surface 20 of the back plate 15. In particular, the elastic electrode 71 contains two curved spring sections 72 and 73 which provide an enhanced outward spring force to thereby insure that proper contact is maintained between the elastic electrode 71 and the terminals of a battery pack.

While the invention has been described above with respect to certain embodiments thereof, it will be appreciated that variations and modifications may be made without departing from the spirit and scope of the invention.

I claim:

1. A photographic lamp unit comprising a lamp body having means for attaching a lamp bulb, and a battery seat having:

means for accommodating and holding a battery, and means for establishing an electrical circuit irrespective of the battery configuration and irrespective of the terminal configuration thereof, said means comprising remotely located, electrically interconnected terminals within the seat.

2. The photographic lamp unit of claim 1 wherein said means of accommodating and holding a battery comprises at least two lips which are disposed oppositely from one another on an exterior surface of said battery seat.

3. The photographic lamp unit of claim 1 wherein said means for establishing an electrical circuit comprises a plurality of electrical terminals disposed on an exterior surface of said battery seat and wiring disposed on an interior surface of said battery seat.

4. The photographic lamp unit of claim 1 further comprising a switch for selectively breaking said electrical circuit.

5. A photographic lamp unit comprising a lamp body and a back plate attached thereto, said back plate having:

an interior surface;

an exterior surface, said interior and exterior surfaces having a plurality of openings which communicate between said interior surface and said exterior surface;

an electrical contact terminal for each of said plurality of openings, each of said electrical contact terminals protruding from said interior surface to said exterior surface through a respective one of said plurality of openings;

upper and lower lips disposed oppositely from one another on said exterior surface;

upper and lower electrical terminals respectively disposed in said upper and lower lips, said upper and lower electrical terminals extending from said interior surface to said exterior surface;

at least two grooves communicating between an upper portion of said interior surface and said exterior surface;

medial and lateral electrical terminals disposed through said at least two grooves; and wiring on said interior surface, for electrically connecting said upper and lower electrical terminals, said medical and lateral electrical terminals, and said electrical contact terminals such that whenever a battery is inserted and engages the exterior surface of said back plate an electrical circuit is formed through the lamp unit regardless of which particular type of battery is used.

6. A back plate for a photographic lamp unit, said back plate comprising:

an interior surface;

an exterior surface, said interior and exterior surfaces having a plurality of openings which communicate between said interior surface and said exterior surface;

an electrical contact terminal for each of said plurality of openings, each of said electrical contact terminals protruding from said interior surface to said exterior surface through a respective one of said plurality of openings;

upper and lower lips disposed oppositely from one another on said exterior surface;

upper and lower electrical terminals respectively disposed in said upper and lower lips, said upper and lower electrical terminals extending from said interior surface to said exterior surface;

at least two grooves communicating between an upper portion of said interior surface and said exterior surface;

medial and lateral electrical terminals disposed through said at least two grooves; and wiring on said interior surface, for electrically connecting said upper and lower electrical terminals, said medial and lateral electrical terminals, and said electrical contact terminals such that whenever a battery is inserted and engages the exterior surface of said back plate an electrical circuit is formed through a lamp unit regardless of which particular type of battery is used.

7. The back plate of claim 6, further comprising a switch for selectively breaking said electrical circuit.

* * * * *